US005435327A

United States Patent [19]

Ho

[11] Patent Number: 5,435,327

[45] Date of Patent: Jul. 25, 1995

[54] GROOMING DEVICE

[76] Inventor: Wai C. Ho, Flat C, D & K, 2Fl., Block 3, Golden Dragon Ind. Center, 172 180 Tai Lin Pai Rd., Kwai Chung, N.T., Kowloon, Hong Kong

[21] Appl. No.: 81,319

[22] PCT Filed: Sep. 5, 1991

[86] PCT No.: PCT/GB91/01516

§ 371 Date: Jun. 18, 1993

§ 102(e) Date: Jun. 18, 1993

[87] PCT Pub. No.: WO92/10959

PCT Pub. Date: Jul. 9, 1992

[30] Foreign Application Priority Data

Dec. 19, 1990 [GB] United Kingdom ..... 9027510

[51] Int. Cl.[6] ..... A45D 24/10

[52] U.S. Cl. ..... 132/118; 132/271; 34/97; 34/100; 119/85

[58] Field of Search ..... 132/119.1, 117, 118, 132/148, 152, 219, 271, 272; 34/96, 97, 100; 119/83, 85

[56] References Cited

U.S. PATENT DOCUMENTS 2,999,263 9/1961 Smith .
3,102,941 9/1963 Pope ..... 132/232

FOREIGN PATENT DOCUMENTS 0061439 9/1982 European Pat. Off. .
1522405 4/1968 France .
2396526 2/1979 France .

*Primary Examiner*—John G. Weiss
*Attorney, Agent, or Firm*—Young & Thompson

[57] ABSTRACT

A hand-held grooming device has a comb which protrudes from a slot through which air is drawn and used by a fan driven by an electric motor. Loose hairs and dandruff are thus drawn into the device and collected by a filter. The same air is then blown out through an orifice which can be rotated about the axis of the device, at a point adjacent the point from which the air was drawn into the device. A heater can be switched on to heat the exhaust air. Thus, the same air which is drawn into the device to remove loose hairs and dandruff, after such removal is returned to the same location to dry or warm or cool the location from which the hair was withdrawn. The device is useful not only in connection with hair but also the removal of lint or dust from clothing.

14 Claims, 3 Drawing Sheets

GROOMING DEVICE

Figure 1:
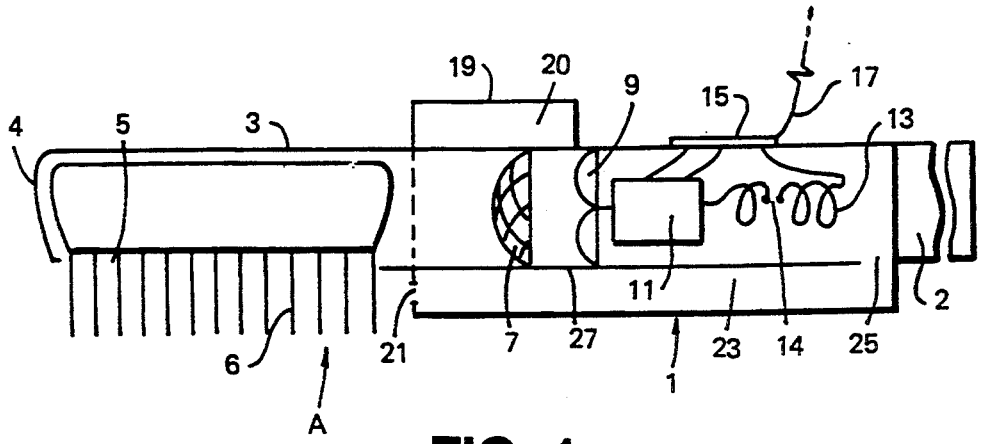

This invention relates to devices for grooming. The purpose of the invention is to collect unsightly hairs and dandruff that are removed whilst grooming one's hair.

Broadly the grooming device of the invention comprises grooming means, conduit means which extend from an inlet orifice adjacent the grooming means to an outlet orifice also adjacent the grooming means, means for generating a flow of air in the conduit means and debris-collection means which extract debris from the air flowing in the conduit means.

In this specification, the term "grooming means" is used to cover tines forming a comb, bristles of any material forming a brush and also any other elements intended for use for grooming purposes.

Furthermore, this device should not be considered limited to use on hair. For example, when the grooming means is a brush, the device can be used to remove lint and dust from clothing.

In a preferred embodiment of the invention, the air-flow generating means is contained in a housing on which the grooming means is mounted. Advantageously the housing is elongate and capable of being held in the hand and the grooming means is mounted on an elongate extension portion to a main portion of the housing, the conduit means having a first conduit portion inside the main housing and a second conduit portion inside the extension portion.

With the latter construction, one orifice of the conduit means can be a slot extending longitudinally of the extension portion. The grooming means may then comprise an array of tines or bristles which extends longitudinally from the slot, through which the tines or bristles extend.

Preferably, the air-flow generating means comprises a fan driven by an electric motor. The electric motor may be of a type that operates from an AC power supply only or alternatively from a DC power supply only, or further alternatively from either an AC or a DC power supply.

Advantageously, there is provided a selectively energizable heating means for heating the exhaust air prior to expulsion through the conduit means outlet. The heating means can be an electric element.

It is a further optional feature of this invention that the position of the conduit means outlet relative to the grooming means is adjustable around the longitudinal axis of the housing and its extension portion, the grooming means extending over only part of the circumference of the extension portion. There may be included means for adjusting the operative area of the inlet orifice of the device in order to vary the airflow therethrough. Conveniently the debris collection means comprises a removable mesh filter.

In a further preferred embodiment of the invention the first conduit portion has at its ends proximate orifices forming an inlet to and outlet from the main housing, and the extension portion can be separably attached to either orifice of the first conduit portion by locating means, whereby the device can be assembled in a selected one of two configurations, in the first of which the extension portion is located in the inlet orifice of the first conduit portion, an orifice of the second conduit portion in the extension portion forms the inlet orifice of the device and the outlet orifice of the first conduit portion leads to or forms the outlet of the device, and in the second of which the extension portion is located in the outlet orifice of the first conduit portion, an orifice of the second conduit portion in the extension portion forms the outlet orifice of the device and the inlet orifice of the first conduit portion leads from or forms the inlet orifice of the device.

Further preferred features of both embodiments of the invention are disclosed in the dependent claims.

Figure 2:
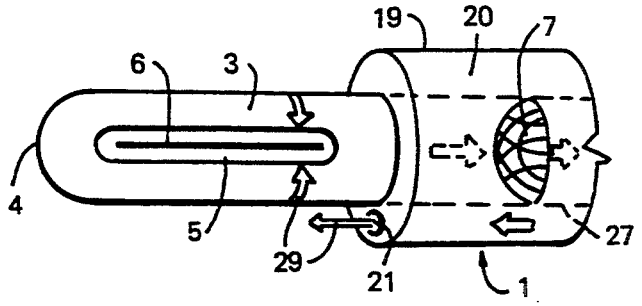
Figure 3:
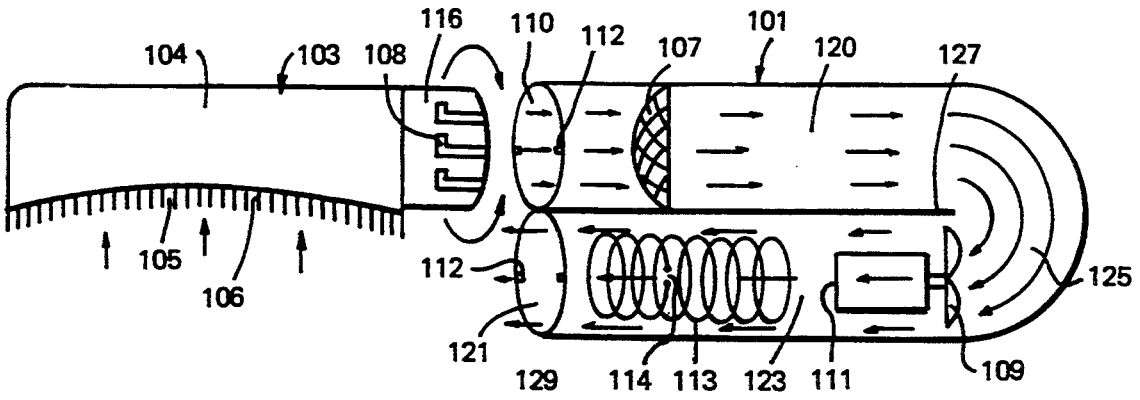
Figure 4:
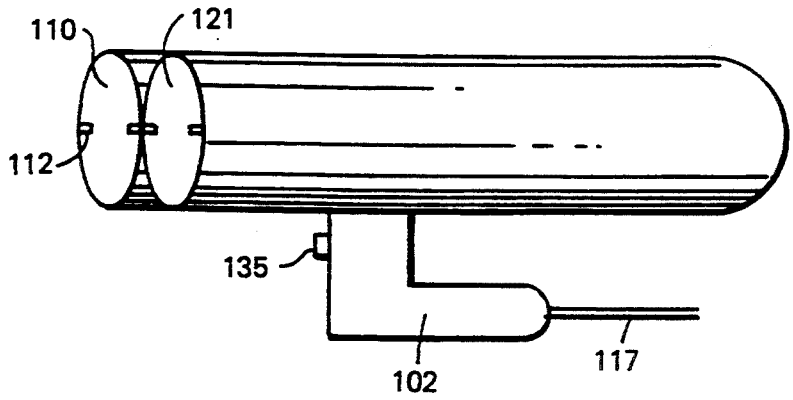
Figure 5:
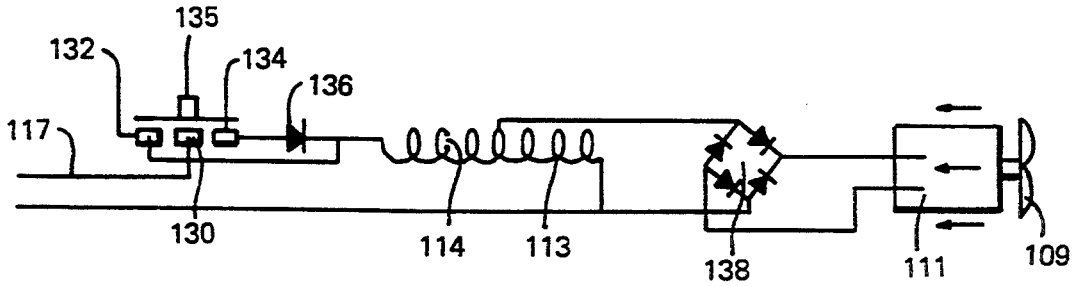
Figure 6:
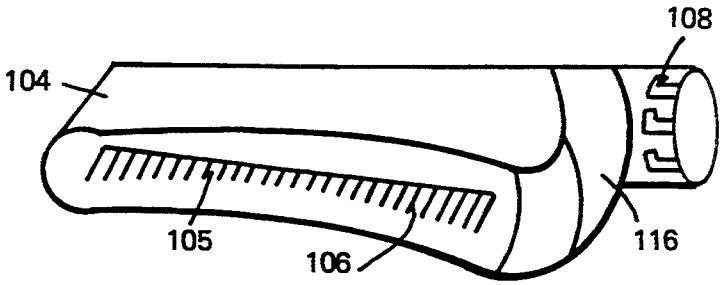
Figure 7:
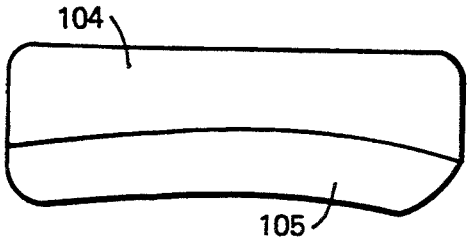
Figure 8:
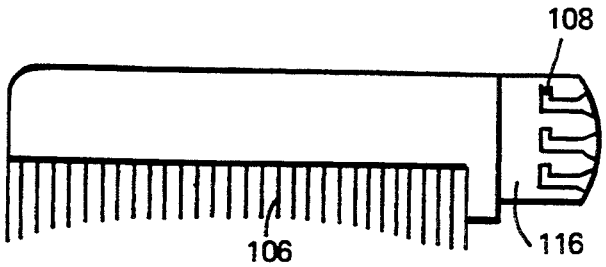
Figure 9:
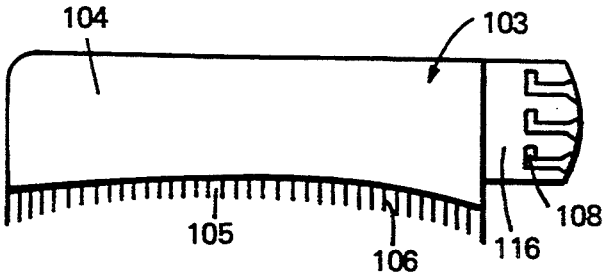

Embodiments of the invention are described below with reference to the drawings in which:

FIG. 1 is a sectional side view of a hair groomer,

FIG. 2 is a perspective view of part of FIG. 1 viewed in the direction of arrow A, FIG. 3 is a perspective view of a second hair groomer with its internal parts shown schematically, FIG. 4 is a perspective view of the body of the groomer shown in FIG. 3, FIG. 5 shows an electrical control circuit of the groomer of FIGS. 3 and 4, FIG. 6 is a perspective view of a removable comb portion of the groomer of FIGS. 3 and 4, FIG. 7 is a side view of a cover for the comb portion shown in FIG. 6, FIG. 8 is a side view of the comb portion shown in FIG. 6, and FIG. 9 is a side view of the assembled comb portion and cover.

The hair groomer shown in FIGS. 1 and 2 comprises a hollow tubular housing 1 of circular cross-section which is closed at its rearward end, to which a handle 2 is attached. At its forward end the housing is attached to a hollow extension portion 3 of circular cross-section having a domed front end 4. The cylindrical wall of the extension portion 3 has a slot 5 which forms an inlet orifice. A shutter or other means may be provided for selective adjustment of the area of the inlet orifice and thereby the inlet airflow. A row of tines which can pivot about the axis the extension portion 3 protrudes from the slot 5 forming a comb 6. Within the tubular housing 1 behind the comb 6 there is a mesh 7 which extends across the hollow cross-section of housing 1 which is in communication with the extension portion 3. The mesh 7 traps hair and other debris which is sucked into the groomer in use.

Behind the mesh 7 in the housing 1 there is a fan 9, an electric motor 11, an AC heating element 13 and a switch 14 to protect against overheating. The motor 11 drives the fan 9. A three-way switch 15 connects the motor 11 and the heater 13 operating either separately or together through a flex 17 to an external AC power source. Alternatively, if the AC heater 13 is omitted, the groomer can operate using low voltage DC batteries housed inside the housing, as there will be sufficient power to drive the motor 11 and the fan 9 alone.

At the forward end of the tubular housing 1 and behind the slot 5, a collar 19 is fixed to the housing 1 in order to create the forward part of an annular chamber 20. The collar 19 contains an offset orifice 21. The back of the collar 19 is sealed to the housing 1 and thus an annular conduit is formed between the collar 19 and the housing 1. The annular conduit is in communication through a passage 23, formed by an internal partition 27, with the heater 13 and the fan The fan 9 draws air through the slot 5 and exhausts air through the orifice 21. The air flows in the direction shown by the open arrows 29 in FIG. 2. The direction from which air is drawn through the slot 5 can be slightly adjusted by rotating the comb 6 around part of the circumference of the housing and within the slot 5. The outlet orifice 21 can be moved by axial rotation of the collar 19 and therefore the outlet 21 acts as a directable nozzle through which either hot or cold air can be blown onto the comb 6.

For use as a hair-groomer, the device will draw in loose hairs and dandruff from the hair whilst the hair is being groomed. At the same time, either hot or told air can be blown onto the hair, if desired. The mesh filter is accessed periodically, after opening the housing 1, so that accumulated debris can be removed.

The second hair groomer, shown in FIGS. 3 to 9, will now be described. Elements of the second groomer corresponding to elements of the first groomer are numbered with the addition of one hundred to those numbers used in FIGS. 1 and 2.

The second embodiment comprises a U-shaped tubular housing 101 of substantially constant circular cross section, the open ends of which provide adjacent inlet and outlet orifices 110, 121. An extension portion 103 to the device comprises a comb part 106 and a hood part 104 which is detachable from the comb part 106 for ease of cleaning of the comb.

The comb part 106 either with or without the detachable hood part 104 is separably attached by location of its cylindrical tubular end 116 inside either the inlet orifice 110 or the outlet orifice 121 of the housing 101.

For this, the tubular end 116 of the comb part 106 has a series of pairs of L-shaped notches 108 in its outer circumference. Both the orifices 110, 121 of the housing 101 contain a pair of projections 112 on their inner surface. When either orifice 110, 121 receives the end 116 of the comb part 106, the projections 112 locate in the inner ends of the L-shaped notches 108 to attach the comb part 108 securely to the housing 101. The comb part 106 can be slid out of the housing by twisting the comb part 106 in the orifice to release the projections 112 from the notches 108.

The angle between the tines of the comb 106 and the handle 102 attached to the housing is selected by locating the projections 112 in an appropriate pair of notches 108.

The circuit shown in FIG. 5 can be used to operate the AC heating element and/or the motor of either the first or the second groomer.

A three-way switch has fixed contacts 130, 132, 134 and a slidable contact 135. The middle fixed contact 130 is connected to the live mains, optionally via a transformer (not shown). The second fixed contact 132 is connected directly to the AC heating element 113 which contains a heat sensitive switch 114 to protect the element 113 from overheating. The third fixed contact 134 is also connected to the element 113 via a diode 136. The element 113 is connected across the mains and in parallel with it is a four diode rectifying bridge 138, the DC output of which is connected to a DC motor 111 which drives the fan 109.

To operate the groomer to supply hot air, the slidable contact 135 is positioned across the fixed contact 132 and 130 which connects the AC supply across the AC heating element 113 and the rectifying bridge 138 which in turn supplies an unsmoothed DC voltage to the motor 111 operating the fan 109, Thus hot air is blown through the passages 120, 125 and 123 in the direction shown by arrows 129.

If only warm (i.e. not too hot) air is desired, the slidable contact 135 is moved to join the contacts 130 and 134, The diode 136 rectifies the AC supply and half-wave DC supply reaching the AC element 113 both heats the AC heating element 113 and operates the DC motor 111 at reduced powers, Thus the fan 109 will drive warm air through the groomer.

The main function of the diode 136 is to decrease the temperature of AC element 113 and the speed of the DC motor 111, Thus the user of the device can select hot air blown strongly or warm air blown less strongly.

The projections 112 inside the orifices 110, 121 of the housing allow the comb part 106 to be positioned in either orifice, according to the choice of the user, When the comb part is positioned in the orifice 110 the slot 105 around the tines 106 forms the inlet orifice of the groomer and outlet air is blown from the orifice 121 adjacent the tines 106, When the comb part is positioned in the orifice 121, the orifice 110 is adjacent the tines 106 and forms the inlet orifice, whilst the slot 105 forms the outlet orifice.

The second groomer has the advantage that the comb hood 104 is removable for ease of cleaning the comb 106, The comb hood 104 also acts to concentrate the air flow around the tines, The position of the AC heating element 113 near to the outlet orifice 121 prevents hot air circulating through the device and damaging the internal components.

I claim:

1. A grooming device comprising grooming means having an inlet orifice, conduit means which extend from the inlet orifice of the grooming means to an outlet orifice adjacent the grooming means, means for generating a flow of air in the conduit means, a debris-collection means inside of said conduit means which extracts debris from the air flowing within the conduit means, the inlet orifice and outlet orifice and the conduit means being so disposed that air entering the inlet orifice of the grooming means defines an air flow path, said air then passing through said conduit means and being returned by said outlet orifice to a point adjacent the point from which the air was drawn into the inlet orifice and intersecting said air flow path, thereby causing some air to be recirculated.

2. A device according to claim 1, in which the grooming means comprises an array of bristles.

3. A device according to claim 1, including selectively energizable heating means for heating the air prior to expulsion through the outlet orifice.

4. A device according to claim 3, in which the heating means is an electric element.

5. A device according to claim 4, in which the electric element contains heat-sensitive switch means to protect against over-heating.

6. A device according to claim 3, further comprising means for selecting the power level of the heater from one of a plurality of different powers.

7. A device according to claim 1, in which the position of said outlet orifice is adjustable relative to the grooming means.

8. A device according to any claim 1, which the air-flow generating means comprises a fan driven by an electric motor.

9. A device according to claim 8, in which the electric motor is provided with an AC rectifying means.

10. A device according to claim 8, further comprising means for selecting the power level of the electric motor from one of a plurality of different power levels.

11. A device according to claim 1, in which the debris collection means comprises a mesh filter.

12. A grooming device comprising grooming means, conduit means which extend from an inlet orifice adjacent the grooming means to an outlet orifice also adjacent the grooming means, means for generating a flow of air in the conduit means and debris-collection means which extract debris from the air flowing within the conduit means, in which the air-flow generating means is contained in a housing on which the grooming means is mounted, and in which the housing is elongate and capable of being held in the hand and the grooming means is mounted on an elongate extension portion to a main portion of the housing, the conduit means having a first conduit portion inside said main portion of the housing and a second conduit portion inside the extension portion, and in which the extension portion is removably attached to said main portion of the housing, and in which the first conduit portion has at its ends proximate orifices forming an inlet to and outlet from said main portion of the housing, and the extension portion can be separably attached to either orifice of the first conduit portion by locating means, whereby the device can be assembled in a selected one of two configurations, in the first of which the extension portion is located in the inlet orifice of the first conduit portion, an orifice of the second conduit portion in the extension portion forms the inlet orifice of the device and the outlet orifice of the first conduit portion leads to or forms the outlet of the device, and in the second of which the extension portion is located in the outlet orifice of the first conduit portion, an orifice of the second conduit portion in the extension portion forms the outlet orifice of the device and the inlet orifice of the first conduit portion leads from or forms the inlet orifice of the device.

13. A device according to claim 12 in which the locating means comprises contours on the extension portion and corresponding contours in each orifice of the first conduit portion.

14. A grooming device comprising grooming means, conduit means which extend from an inlet orifice adjacent the grooming means to an outlet orifice also adjacent the grooming means, means for generating a flow of air in the conduit means and debris-collection means which extract debris from the air flowing within the conduit means, in which the air-flow generating means is contained in a housing on which the grooming means is mounted, and in which the housing is elongate and capable of being held in the hand and the grooming means is mounted on an elongate extension portion to a main portion of the housing, the conduit means having a first conduit portion inside said main portion of the housing and a second conduit portion inside the extension portion, and in which said outlet is adjacent the grooming means and its position relative to the grooming means is adjustable around a longitudinal axis of the housing and its extension portion, the grooming means extending over only part of the periphery of the extension portion, and in which the conduit means includes an annular chamber which extends around the longitudinal axis, the conduit means outlet being an orifice formed in a member rotatable about the axis and the orifice being offset from this axis.

* * * * *